US011482784B2

(12) United States Patent
Pasko et al.

(10) Patent No.: US 11,482,784 B2
(45) Date of Patent: Oct. 25, 2022

(54) ANTENNA

(71) Applicant: Schaffner EMV AG, Luterbach (CH)

(72) Inventors: Szymon Pasko, Orzesze (PL); Stéphane Lebreton, Morschwiller-le-bas (FR); Shemsi Musiqi, Rüttenen (CH)

(73) Assignee: Schaffner EMV AG, Luterbach (CH)

( * ) Notice: Subject to any disclaimer, the term of this patent is extended or adjusted under 35 U.S.C. 154(b) by 55 days.

(21) Appl. No.: 16/845,905

(22) Filed: Apr. 10, 2020

(65) Prior Publication Data

US 2020/0328514 A1 Oct. 15, 2020

(30) Foreign Application Priority Data

Apr. 15, 2019 (EP) ..... 19169288

(51) Int. Cl.
*H01Q 7/08* (2006.01)
*H01Q 1/32* (2006.01)

(52) U.S. Cl.
CPC ..... *H01Q 7/08* (2013.01); *H01Q 1/3241* (2013.01)

(58) Field of Classification Search
CPC ..... H01Q 7/08; H01Q 1/3241
See application file for complete search history.

(56) References Cited

U.S. PATENT DOCUMENTS

| | | | | |
|---|---|---|---|---|
| 6,400,330 | B1 * | 6/2002 | Maruyama | H01Q 1/241 343/713 |
| 6,919,856 | B2 | 7/2005 | Swoboda et al. | |
| 10,056,687 | B2 | 8/2018 | Rojas Cuevas et al. | |
| 2004/0252068 | A1 | 12/2004 | Hall et al. | |
| 2018/0122551 | A1 | 5/2018 | Yoshikawa | |
| 2018/0159224 | A1 | 6/2018 | Inoue et al. | |
| 2018/0342805 | A1 | 11/2018 | Sicklinger et al. | |

FOREIGN PATENT DOCUMENTS

| | | | |
|---|---|---|---|
| DE | 202015107067 | A1 | 1/2016 |
| DE | 102016010493 | A1 | 3/2018 |
| EP | 1397845 | A2 | 3/2004 |

* cited by examiner

*Primary Examiner* — Dieu Hien T Duong
(74) *Attorney, Agent, or Firm* — Blank Rome LLP

(57) ABSTRACT

Antenna having a magnetic core (1) and a coil (2), which is wound around the magnetic core (1), the magnetic core (1) having at least two first partial cores (1.1) and at least one second partial core (1.2), the at least two first partial cores (1.1) being arranged one behind the other in a longitudinal direction (8) of the magnetic core (1), each of the at least two first partial cores (1.1) having a lateral side, the at least two first partial cores (1.1) having a first first partial core (1.1) and a second first partial core (1.1), the at least one second partial core (1.2) having a first second partial core (1.2), which is arranged on the lateral side of the first first partial core (1.1) and on the lateral side of the second first partial core (1.1) such that the first second partial core (1.2) overlaps at least partially with the first first partial core (1.1) and at least partially with the second first partial core (1.1).

15 Claims, 5 Drawing Sheets

ANTENNA

RELATED APPLICATION

The present application claims the benefit of European Patent Application EP20190169288.8, filed Apr. 15, 2019. The entire disclosure of which is hereby incorporated by reference.

TECHNICAL FIELD

The invention relates to an antenna, in particular to an antenna for use in a vehicle designed for the transmission of key data for opening and/or starting the vehicle.

PRIOR ART

Antennas generally consist of a core and a coil. Depending on the transmission frequency and the band width, the core and the coil must be correspondingly designed. The band widths of antennas are becoming ever wider, for example for UWB antennas, and the range of the antenna is becoming ever greater, which has the consequence for example that the cores are also becoming ever longer. However, long cores are also more liable to rupture than short cores and are more difficult to produce.

It has therefore become known in the meantime to form the core by a plurality of partial cores arranged one behind the other, for example in US10056687, EP1397845, US2018159224. This has the advantage that the individual partial cores are easier to produce and the partial cores are less liable to rupture. However, it has been found that the magnetic properties of the core formed from a number of partial cores are very susceptible to shocks or temperature fluctuations and these antennas often have problems with respect to the stability of the antenna properties. The partial cores are arranged one behind the other, either with a gap or in contact. If the partial cores are in contact, the magnetic properties fluctuate with the contact pressure between the partial cores, which may vary according to temperature or vibrations. If the partial cores are arranged at a distance from one another, the distance often varies according to the temperature or external force effects, which in turn adversely affects the electrical properties of the core, and consequently of the antenna. Therefore, it has not been possible so far to successfully obtain an antenna of high quality with a plurality of partial cores.

SHORT DESCRIPTION OF THE INVENTION

It is an aim of the invention to find an antenna that is robust, easy to produce, and has good and stable antenna properties.

This aim is achieved according to the invention in the case of an antenna and a production process for such an antenna according to the independent claims.

The use of the at least one second partial core, which laterally overlaps two of the at least two first partial cores, allows magnetic bridging of the point of contact or the gap between the first partial cores. Consequently, the core is independent of the contact pressure or the size of the gap between the first partial cores, and consequently independent of temperature fluctuations and vibrations and other external influences. At the same time, the core can be formed from a number of partial cores, which makes production easier and is advantageous for the rupture stability of the core.

Further advantageous embodiments are specified in the dependent claims.

BRIEF DESCRIPTION OF THE FIGURES

The invention is explained more specifically on the basis of the accompanying figures, in which.

EXEMPLARY EMBODIMENTS OF THE INVENTION

Figure 1:
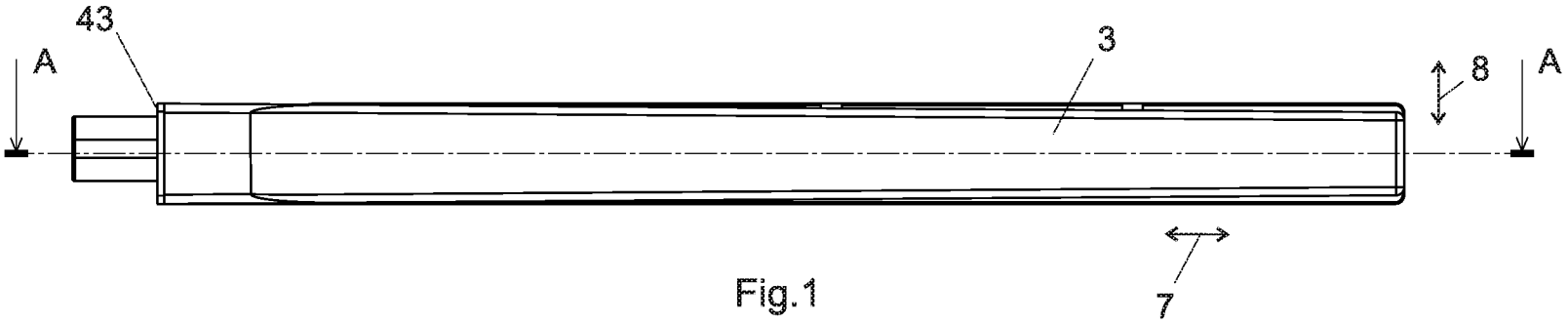
FIG. 1 shows a first side view of an antenna according to a first exemplary embodiment of the invention.
Figure 2:
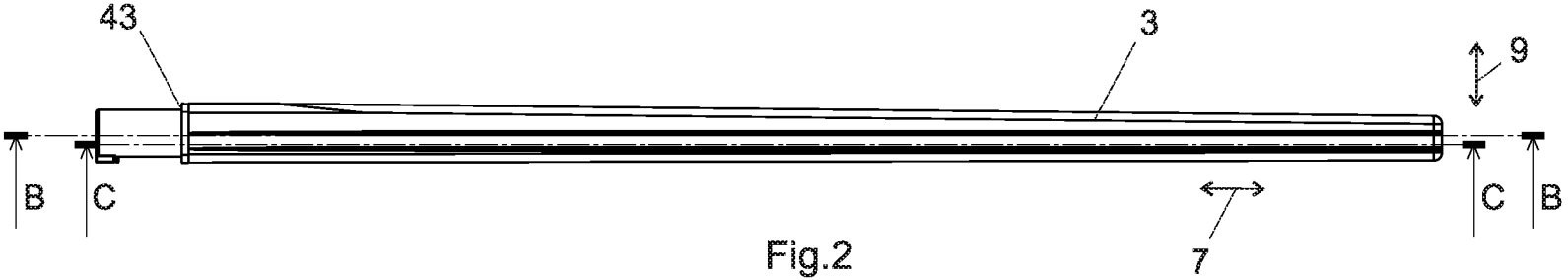
FIG. 2 shows a second side view of the antenna according to the first exemplary embodiment.
Figure 3:
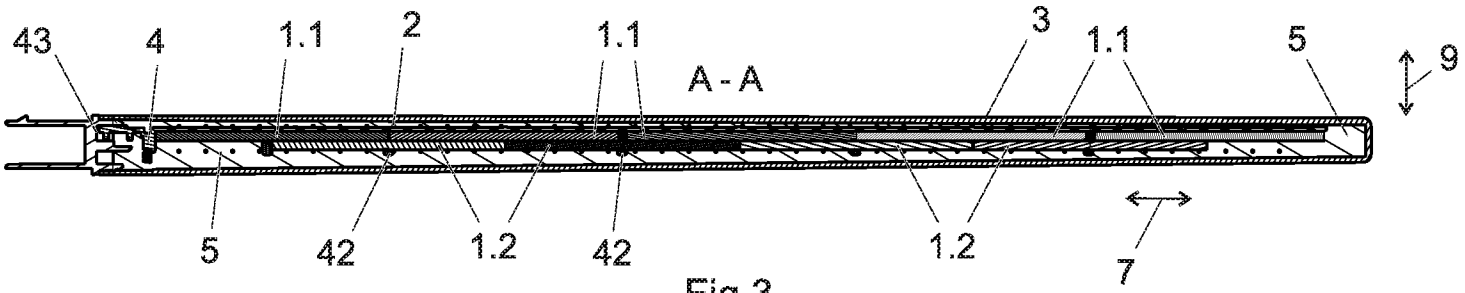
FIG. 3 shows a sectional view along the line A-A of the antenna according to the first exemplary embodiment.
Figure 4:
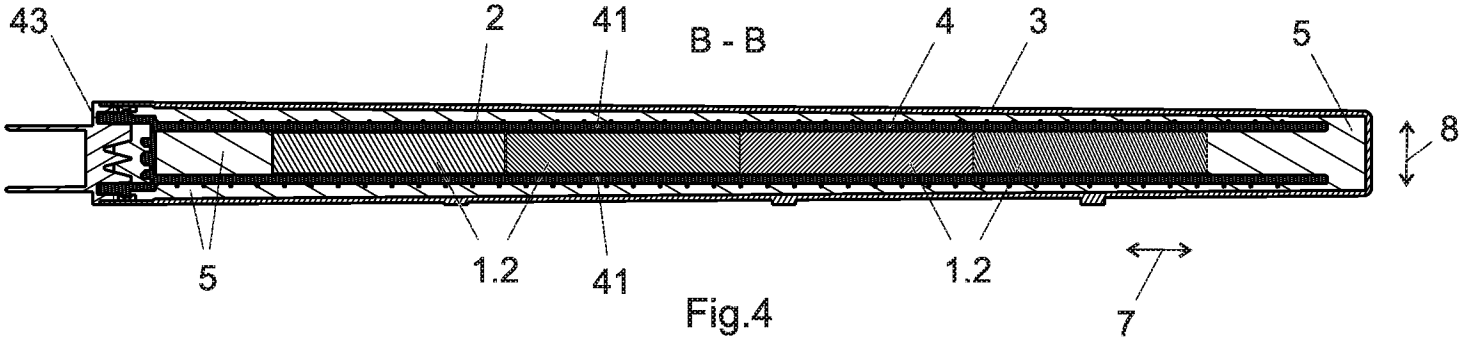
FIG. 4 shows a sectional view along the line B-B of the antenna according to the first exemplary embodiment.
Figure 5:
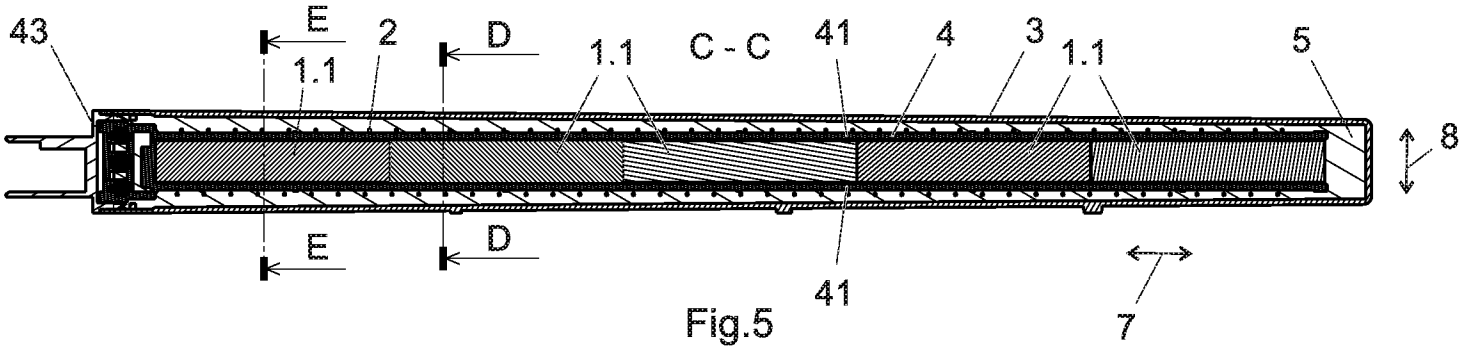
FIG. 5 shows a sectional view along the line C-C of the antenna according to the first exemplary embodiment.
Figure 6:
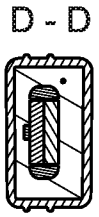
FIG. 6 shows a sectional view along the line D-D of the antenna according to the first exemplary embodiment.
Figure 7:
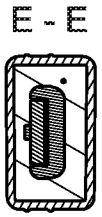
FIG. 7 shows a sectional view along the line E-E of the antenna according to the first exemplary embodiment.
Figure 8:
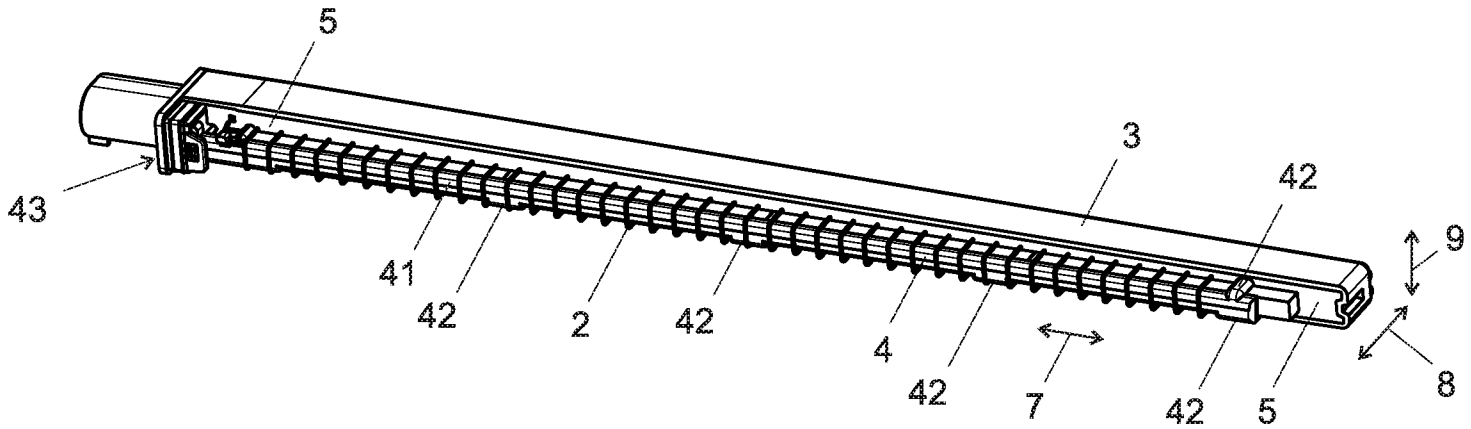
FIG. 8 shows a 3D view of an antenna according to a second exemplary embodiment of the invention with a half cut-open housing and potting material.
Figure 9:
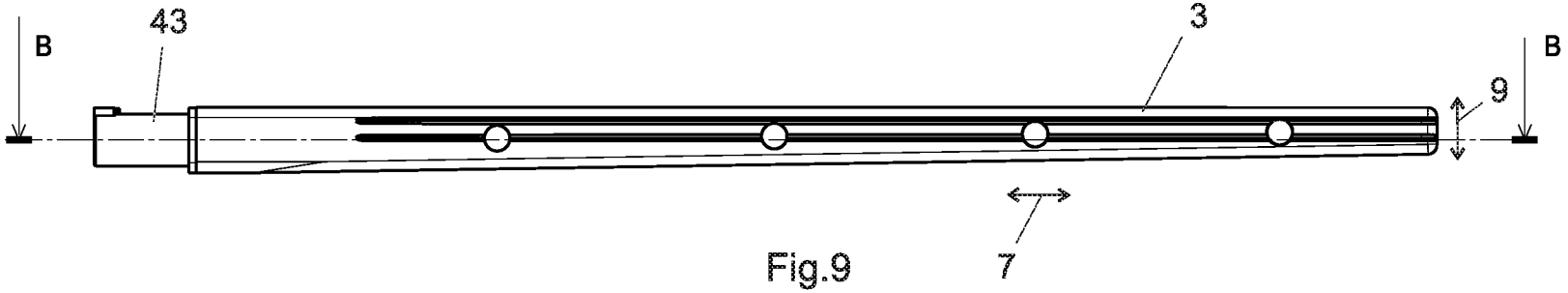
FIG. 9 shows a first side view of the antenna according to the second exemplary embodiment.
Figure 10:
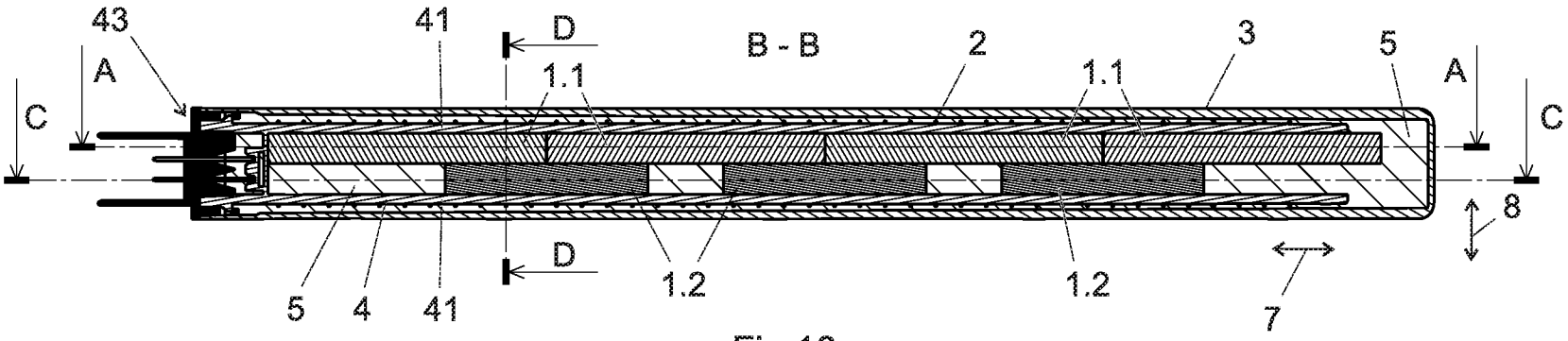
FIG. 10 shows a sectional view along the line B-B of the antenna according to the second exemplary embodiment.
Figure 11:
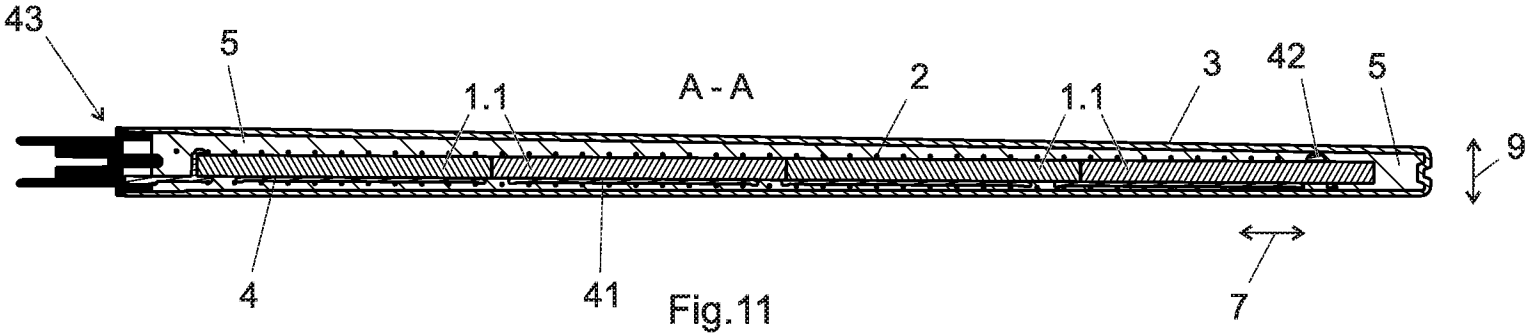
FIG. 11 shows a sectional view along the line A-A of the antenna according to the second exemplary embodiment.
Figure 12:
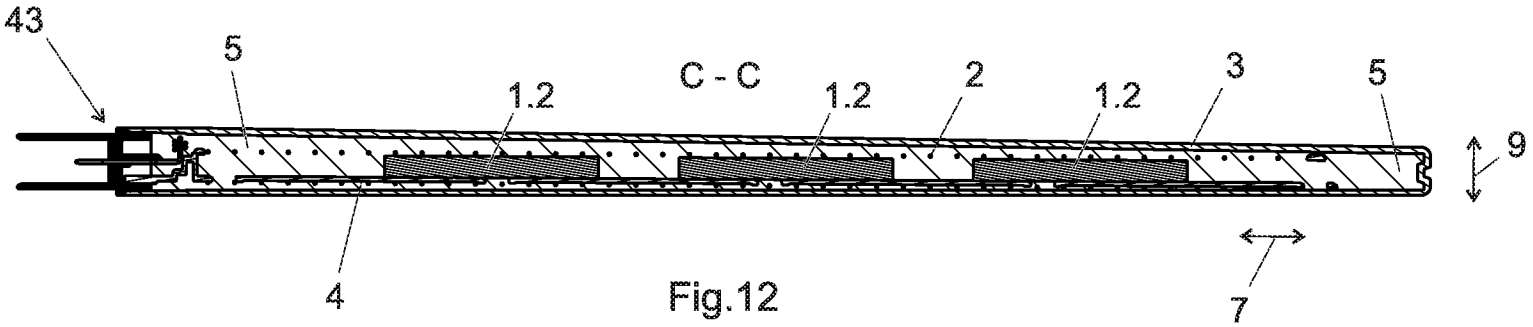
FIG. 12 shows a sectional view along the line C-C of the antenna according to the second exemplary embodiment.
Figure 13:
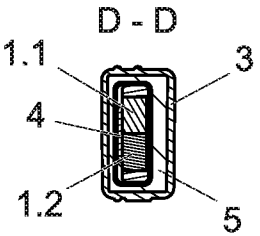
FIG. 13 shows a sectional view along the line D-D of the antenna according to the second exemplary embodiment.

FIGS. 1 to 7 show a first exemplary embodiment of the invention. FIGS. 8 to 13 show a second exemplary embodiment of the invention. Both exemplary embodiments are described together below. Should the first and second exemplary embodiments differ in a feature, this is explicitly mentioned. Otherwise, all of the features described apply to both exemplary embodiments.

In the following description, three orthogonal directions are used, a first direction 7, a second direction 8 and a third direction 9. The first direction 7 is preferably orthogonal to the second direction 8 and the third direction 9. The second direction 8 is preferably orthogonal to the first direction 7 and the third direction 9. The third direction 9 is preferably orthogonal to the first direction 7 and the second direction 8.

The antenna has a core 1 and a coil 2. The antenna preferably also has a housing 3, a core support 4 and a potting compound 5.

The core 1 is a magnetic core. The core 1 is made of a magnetic material. Magnetic material means that the material is paramagnetic or ferromagnetic, preferably ferromagnetic. The core 1 is preferably made of a ferrite material (ferrite material) or a powder material (powder core). The magnetic core 1 is preferably made of a rigid magnetic material, i.e. the magnetic core 1 is not elastic or flexible.

The core 1 preferably extends along the first direction 7. The first direction is therefore also referred to as the longitudinal direction 7 of the core 1. The longitudinal axis of the core 1 consequently extends in the first direction 7. The core 1 is preferably longer in the longitudinal direction 7 than in the second direction 8 and the third direction 9. In an exemplary embodiment, the core 1 is larger in the second direction 8 (width) than in the third direction 9 (thickness or height). In another exemplary embodiment, the core 1 is of the same size in the second direction 8 and in the third direction.

According to the invention, the core 1 has at least two first partial cores 1.1 and at least one second partial core 1.2. In the first exemplary embodiment, the core 1 has five first partial cores 1.1 and four second partial cores 1.2. In the second exemplary embodiment, the core 1 has four first partial cores 1.1 and three second partial cores 1.2. However, there can be any number and the number can be varied as desired, depending on the length of the core 1 and depending on the length of the partial cores 1.1, 1.2. The core 1 preferably has n first partial cores 1.1 and n-1 or n second partial cores 1.2, n being equal to or greater than two.

The magnetic material of the core 1, which has been described above, corresponds to the magnetic material of the partial cores 1.1, 1.2. In this case, all of the partial cores 1.1, 1.2 preferably have the same magnetic material. However, it is also possible to use different magnetic materials in different partial cores 1.1, 1.2.

The first partial cores 1.1 have a longitudinal axis which extends in the longitudinal direction 7. The first partial cores 1.1 are preferably longer in the longitudinal direction 7 than in the second direction 8 and/or than in the third direction 9. The first partial cores 1.1 preferably have a lateral side. The lateral side is preferably arranged parallel to the longitudinal direction 7. The orthonormal vector of the lateral side of the first partial cores 1.1 is preferably parallel to the second direction 8 or to the third direction 9. The lateral side preferably forms a planar surface. The first partial cores 1.1 preferably have a first axial side and a second axial side opposite from the first axial side. The first and/or second axial sides are preferably at right angles to the lateral side or to the longitudinal axis 7 of the respective first partial core 1.1. The first and second axial sides are preferably arranged parallel to one another. The first and/or second axial sides preferably form a planar surface. The first partial cores 1.1 preferably have in each case a rectangular cross section. The lateral side of all of the first partial cores 1.1 is preferably formed the same. However, other cross-sectional shapes, such as for example triangular, semicircular, etc., are also conceivable. The cross-sectional shape of the first partial cores 1.1 is preferably constant/the same along the longitudinal direction 7 of the first partial core 1.1. All of the first partial cores 1.1 preferably have the same cross-sectional shape. The cross-sectional shape of the first partial core 1.1 is defined as the cross section at right angles to the longitudinal direction 7. The first partial cores 1.1 are preferably cuboidal, i.e. formed with six sides arranged at right angles to one another. All of the first partial cores 1.1 are preferably formed with the same shape.

The second partial cores 1.2 have a longitudinal axis, which extends in the longitudinal direction 7. The second partial cores 1.2 are preferably longer in the longitudinal direction 7 than in the second direction 8 and/or than in the third direction 9. The second partial cores 1.2 preferably have a lateral side. The lateral side is preferably arranged parallel to the longitudinal direction 7 and/or parallel to the parallel side of the first partial cores 1.1. The orthonormal vector of the lateral side of the second partial cores 1.2 is preferably parallel to the second direction 8 or to the third direction 9 or to the orthonormal vector of the lateral side of the first partial cores 1.1. The shape of the lateral side of the second partial cores 1.2 preferably corresponds to the shape of the lateral side of the first partial cores 1.1, so that the lateral side of the second partial cores 1.2 can lie (over its full surface area) on the lateral sides of the first partial cores 1.1. The lateral side preferably forms a planar surface. The second partial cores 1.2 preferably have a first axial side and a second axial side opposite from the first axial side. The first and/or second axial sides are preferably at right angles to the lateral side or to the longitudinal axis 7 of the respective second partial core 1.2. The first and second axial sides are preferably arranged parallel to one another. The first and/or second axial sides preferably form a planar surface. The second partial cores 1.2 preferably have in each case a rectangular cross section. The lateral side of all of the second partial cores 1.2 is preferably formed the same. However, other cross-sectional shapes, such as for example triangular, semicircular, etc., are also conceivable. The second partial cores 1.2 preferably have the same cross-sectional shape as the first partial cores 1.1. The cross-sectional shape of the second partial cores 1.2 is preferably constant/the same along the longitudinal direction 7 of a partial core 1.2. All of the second partial cores 1.2 preferably have the same cross-sectional shape. The cross-sectional shape of the second partial core 1.2 is defined as the cross section at right angles to the longitudinal direction 7. The second partial cores 1.2 are preferably cuboidal, i.e. formed with six sides arranged at right angles to one another. All of the second partial cores 1.2 are preferably formed with the same shape. The second partial cores 1.2 are preferably formed in the same way as the first partial cores 1.1 (see first exemplary embodiment). However, it is also possible that the first and second partial cores 1.1, 1.2 are differently formed (see second exemplary embodiment with different lengths of the first and second partial cores 1.1, 1.2). The second partial cores 1.2 are preferably identical to the first partial cores 1.1. This allows the same partial cores to be used for the first and second partial cores 1.1 and 1.2. There may however also be advantages in using different partial cores for the first partial cores 1.1 and the second partial cores 1.2. For instance, different magnetic materials could be used. The second partial cores 1.2 could have a higher permeability than the first partial cores 1.1. As a result, the high permeability may only be used for the bridge function, while a simpler (and less expensive) magnetic material with a lower magnetic permeability is chosen for the first partial cores 1.1, which have the main proportion of the magnetic material. Here, the second partial cores 1.2 have been described in the plural. The description also applies of course to an exemplary embodiment with only one second partial core 1.2.

The first partial cores 1.1 are preferably arranged one behind the other in the longitudinal direction 7. The first partial cores 1.1 are preferably arranged one behind the other such that the longitudinal axes of the first partial cores 1.1 are arranged coaxially, i.e. the longitudinal axes of the first partial cores 1.1 form the respective extension of the adjacent first partial cores 1.1. In this case, the first axial side of a first first partial core 1.1 is preferably arranged opposite a first axial side of a second first partial core 1.1. The first partial cores 1.1 are preferably arranged one behind the other such that the first axial side of the first first partial core 1.1 overlaps completely with the first axial side of the second first partial core 1.1, i.e. the axial side of the first first partial core 1.1 overlaps the axial side of the second first partial core 1.1 and/or the axial side of the second first partial core 1.1 overlaps the axial side of the first first partial core 1.1. In other words, a first partial core 1.1 represents an extension of the adjacent first partial core 1.1 in the longitudinal direction 7. In an exemplary embodiment, the first partial cores 1.1 are arranged with a distance between the axial sides of the first partial cores 1.1. In an exemplary embodiment, the axial sides of the first partial cores 1.1 are arranged in contact with one another (see first and second exemplary embodiments). On account of the magnetic bridge described below through the second partial cores 1.2, it makes no difference magnetically whether the first partial cores 1.1 are in contact with one another or at a distance from one another. The distance may therefore also be chosen to be large, for example in order to save material.

According to the invention, a first second partial core 1.2 is arranged such that the lateral side of the first second partial core 1.2 overlaps at least a part of the lateral side of a first first partial core 1.1 and at least a part of the lateral side of a second first partial core 1.1. This means that a projection of the first second partial core 1.2 at right angles to the longitudinal axis 7 onto the first first partial core 1.1 intersects the latter, and that a projection of the first second partial core 1.2 at right angles to the longitudinal axis 7 onto the second first partial core 1.1 intersects the latter. Preferably, the lateral side of the first second partial core 1.2 overlaps the lateral side of the first first partial core 1.1 at least with a minimum length of overlap and the lateral side of the second first partial core 1.1 at least with the minimum length of overlap. The minimum length of overlap is in this case at least one percent, preferably at least two percent, of the shortest partial core (in the longitudinal direction 7) of the first first partial core 1.1, of the second first partial core 1.1 and of the first second partial core 1.2, preferably of the shortest of all of the partial cores 1.1, 1.2 (in the longitudinal direction 7). As a result, a magnetic bridge is formed at the contact point between the two first partial cores 1.1 arranged one behind the other, with the effect of eliminating the fluctuations due to temperature and external influences on the junction between the two first partial cores 1.1. For reasons of stability, however, the length of overlap is preferably longer. Preferably, the first partial cores 1.1 are arranged in a first plane and the at least one second partial core 1.2 is arranged in a second plane. The second plane is preferably parallel to the first plane. In one exemplary embodiment, the first plane and/or the second plane is at right angles to the second direction 8, i.e. the first partial cores 1.1 and the at least one second partial core 1.2 are stacked in the second direction 8 (see second exemplary embodiment with stacking direction in the second direction 8). In one exemplary embodiment, the first plane and/or the second plane is at right angles to the third direction 9, i.e. the first partial cores 1.1 and the at least one second partial core 1.2 are stacked in the third direction 9 (see first exemplary embodiment with stacking direction in the third direction 9). The stacking direction could however also be a linear combination of the second and third directions 8 and 9. Preferably, the projection of the first second partial core 1.2 in the direction at right angles to the stacking direction and to the longitudinal direction 7 does not overlap the first first partial core 1.1 and/or the second first partial core 1.1 and/or the projection of the first first partial core 1.1 in the direction at right angles to the stacking direction and the longitudinal direction 7 does not overlap the first second partial core 1.2. In the first exemplary embodiment, that is the projection in the second direction 8 and in the second exemplary embodiment that is the projection in the third direction 9. However, exemplary embodiments in which there is such an overlapping are also conceivable. Thus, for example, two L-shaped cross sections could be placed one on top of the other, so that there are two stacking directions, for example the second and third directions 8 and 9. In this exemplary embodiment, the first partial cores 1.2 and the second partial cores 1.1 have in each case an L-shaped or angle-shaped cross section. The cross section of the first and second partial cores 1.1 and 1.2 put together then gives a right-angled cross section again in an overlapping region. The first partial cores 1.1 and the at least one second partial core 1.2 are preferably formed such that the first partial cores 1.1 and the at least one second partial core 1.2 can be stacked or are stacked in a stacking direction at right angles to the longitudinal axis 7. However, it would also be conceivable to push the at least one second partial core 1.2 into the first partial cores 1.1 in the longitudinal direction, into an axial opening in the longitudinal direction 7. However, this tends to be laborious in production and also has an adverse effect on the risk of rupturing. The lateral side of the second partial core 1.2 is preferably in contact with the lateral sides of the first first partial core 1.1 and of the second first partial core 1.1. The longitudinal axis of the at least one second partial core 1.2 is preferably arranged parallel to the longitudinal axis of the at least two first partial cores 1.1. The lateral side of the at least one second partial core 1.2 is preferably arranged parallel to the lateral sides of the at least two first partial cores 1.1. The cross section of the core 1 (at right angles to the longitudinal axis 7) in the overlapping region of one of the at least one second partial core 1.2 and of one of the at least two first partial cores 1.1 is preferably a rectangle. This rectangular cross section of the core 1 is preferably formed by rectangular cross sections of the corresponding first and second partial cores 1.1 and 1.2. However, it would also be possible to form the rectangular cross section of the core 1 from triangular cross sections, L-shaped cross sections or other cross sections of the first and second partial cores 1.1 and 1.2.

If the core 1 has two or more second partial cores 1.2, the following preferably applies to the arrangement of the second partial cores 1.2. In this case, there is at least one second second partial core 1.2. The second first partial core 1.1 is arranged such that the lateral side of the second first partial core 1.1 overlaps at least part of the lateral side of the first second partial core 1.2 and at least part of the lateral side of the second second partial core 1.2. This means that a projection of the second first partial core 1.1 at right angles to the longitudinal axis 7 onto the first second partial core 1.2 intersects the latter, and that a projection of the second first partial core 1.1 at right angles to the longitudinal axis 7 onto the second second partial core 1.2 intersects the latter. The lateral side of the second first partial core 1.1 preferably overlaps the lateral side of the first second partial core 1.2 at least with a minimum length of overlap and the lateral side of the second second partial core 1.2 at least with the minimum length of overlap. The minimum length of overlap is in this case at least one percent, preferably at least two percent, of the shortest partial core (in the longitudinal direction 7) of the second first partial core 1.1, of the first second partial core 1.2 and of the second second partial core 1.2, preferably of the shortest of all the partial cores 1.1, 1.2 (in the longitudinal direction 7). As a result, a magnetic bridge is formed at the point of contact between the two second partial cores 1.2 arranged one behind the other. The second partial cores 1.2 are preferably arranged one behind the other in the longitudinal direction 7. The second partial cores 1.2 are preferably arranged one behind the other such that the longitudinal axes of the second partial cores 1.2 are arranged coaxially, i.e. the longitudinal axes of the second partial cores 1.2 are the respective extension of the adjacent second partial cores 1.2. In this case, the first axial side of the first second partial core 1.2 is preferably arranged opposite the first axial side of the second second partial core 1.2. The second partial cores 1.2 are preferably arranged one behind the other such that the first axial side of the first second partial core 1.2 overlaps completely with the axial side of the second second partial core 1.2, i.e. the axial side of the first second partial core 1.2 overlaps the first axial side of the second second partial core 1.2 and/or the first axial side of the second second partial core 1.2 overlaps the first axial side of the first second partial core 1.2. In other words, a second partial core 1.2 represents an extension of the adjacent second partial core 1.2 in the longitudinal direction 7. In one exemplary embodiment, the second partial cores 1.2 are arranged with a distance between the axial sides of the second partial cores 1.2 (see second exemplary embodiment). In one exemplary embodiment, the axial sides of the second partial cores 1.2 are arranged in contact with one another (see first exemplary embodiment). The distance may be chosen as large as desired, as long as each first partial core 1.1 extends over the opposite axial sides of two adjacent second partial cores 1.2 and/or in each case overlaps the adjacent second partial cores 1.2 at the lateral side thereof.

The core 1 is consequently formed by a plurality of partial cores 1.1, 1.2 arranged one behind the other and one next to the other. The core 1 has in the longitudinal direction 7 two opposite ends, which are formed by the corresponding ends or axial sides of the respectively last first or second partial cores 1.1, 1.2 in the longitudinal direction 7.

The coil 2 is wound around the core 1, preferably around the core support 4. The winding direction of the coil 2 is in the longitudinal direction 7. The coil 2 preferably has a plurality of turns around the core 1, preferably with more than two, preferably with more than five, preferably with more than ten, preferably with more than fifteen, preferably with more than twenty turns. The coil 2 preferably extends from the first end of the core 1 to the second end of the core 1, so that the region between the last turn of the coil 2 in the direction of the first end of the core 1 and the last turn of the coil 2 in the direction of the second end of the core 1 makes up at least 70%, preferably at least 75%, preferably at least 80%, of the longitudinal extent of the core 1. The coil 2 preferably extends over both first partial cores 1.1, preferably over all of the first partial cores 1.1. The coil 2 or a coil wire of the coil 2 is preferably wound onto the core support 4. However, it is also possible to wind the coil 2 or the coil wire directly onto the core 1 (without a core support 4). The coil 2 preferably has a coil wire, which is wound around the core 1 or the core support 4. The coil wire is preferably insulated. The coil wire is preferably wound such that both ends of the coil wire are connected at one end of the core 1 to terminals of the antenna. In the exemplary embodiment shown, the coil 2 is wound in a direction from the first end of the core 1 to the second end of the core 1 and the core wire is then returned from the second end of the core 1 to the first end of the core 1 (without turns around the core 1). However, it would also be possible first to lead the coil wire from the first end of the core 1 to the second end of the core 1 (without turns around the core 1) and then to wind it in a direction from the second end of the core 1 to the first end of the core 1. It is also possible to wind the coil wire in both directions (cross winding).

The core support 4 is designed to support/hold the core 1. This is especially important for the fitting of the antenna before potting, so that all of the antenna parts are held in the correct position before the antenna is potted. Unless explicitly described otherwise, the features of the core support 4 described below therefore relate to the state before the potting of the antenna. The core support 4 is preferably designed to support the coil 2. The core support 4 preferably has an internal opening, in which the core 1 is held. The core support 4 preferably has an outer surface, on which the coil 2 is wound. The core support 4 preferably fixes the position of the partial cores 1.1, 1.2 with respect to one another (at least in one direction). The core support 4 preferably fixes the partial cores 1.1, 1.2 such that they are at right angles to the longitudinal axis of the core 1 or of the partial cores 1.1, 1.2 (at least in one direction, preferably in all directions 330°, preferably 350°, radially around the longitudinal axis, preferably in all directions radially around the longitudinal direction 7). The coil 2 is preferably wound on the core support 4 or on the core 1 (without the core support 4) such that the coil windings press the two second partial cores 1.2 against the first partial cores 1.1 and thereby fix their position. In one exemplary embodiment, for fitting, the partial cores 1.1, 1.2 are inserted in the direction of the longitudinal axis of the core 1 or of the partial cores 1.1, 1.2. This allows that the partial cores 1.1, 1.2 can be stably positioned in relation to one another and nevertheless can be moved axially in relation to one another. However, it is also possible to insert the partial cores 1.1, 1.2 differently into the core support 4, for example in the stacking direction. The core support 4 preferably extends over at least 70%, preferably at least 80%, preferably at least 90%, of the length of the core 1. This allows stable securing of the partial cores 1.1, 1.2. This is advantageous for the positioning during production, and also stabilizes the potted partial cores 1.1, 1.2 later during use. In the exemplary embodiment shown, the core support 4 has at least one, preferably two, parallel longitudinal support(s) 41 (which extends/extend in the direction of the longitudinal axis of the core 1). The core support 4 preferably has a plurality of transverse supports 42, which prevent/block the movement of the partial cores 1.1, 1.2 radially in relation to the longitudinal axis 7 of the core 1, in particular in the third direction 9. In the region of the transverse supports 42, the winding of the coil 2 is preferably interrupted. Preferably, the transverse supports 42 in each case connect the two longitudinal supports 41. For the description, four sides (at right angles to the longitudinal axis of the core 1) of the core 1 are referred to as the upper side (or first side), lower side (or second side) and two lateral sides (third and fourth sides), without this however restricting the invention to a specific alignment of the antenna. Preferably, the upper and lower sides are arranged opposite and/or the two lateral sides are arranged opposite. There are preferably upper transverse supports 42, against which the upper side of the core 1 lies. There are preferably lower transverse supports 42, against which the lower side of the core 1 lies. The two longitudinal supports 41 are preferably arranged on the two lateral sides of the core 1, so that the two lateral sides of the core 1 lie against the two longitudinal supports. The core support 4 preferably has at one end a closure region 43, which is designed to close an opening in the housing 3 when the core support 4 (with the core 1 and the coil 2) is fitted in the housing 3. The closure region 43 may in this case be produced integrally in one piece with the rest of the core support 4. It is however also possible that the closure region 43 and the rest of the core support 4 are put together from separate parts (see first and second exemplary embodiments). The closure region 43 preferably has a terminal for the electrical connection of the antenna, in particular the coil 2. The terminal preferably has two electrically conducting rods, which extend through the closure region 43. One side of each conducting rod in this case protrudes out of the closure region 43 on the outer side, so that the finished antenna can be electrically connected. The opposite side of each conducting rod protrudes out on the inner side of the closure region 43, the ends of the coil 2 or of the coil wire being connected in each case to one of these conducting rods (on the inner side). The core support 4 is preferably formed such that the core support 4 has a predefined position after fitting in the housing 3. On one side of the antenna, this is achieved for example by the positioning of the closure region 43 in the opening in the housing 3. The core support 4 preferably also has positioning means, which hold the core support 4 in the predefined position when the core support 4 is fitted in the housing 3. The further positioning means are preferably arranged on the region of the core support 4 opposite from the closure region 43. The positioning means have preferably flexible/resilient arms, which press against the inner wall of the housing 3 and thus bring the core support 4 into the predefined position in the housing 3. The resilience of the positioning means achieves the effect of damping the core 1, which provides protection from shocks. The core support 4 is preferably produced from a plastic.

The housing 3 is designed to enclose the core 1 with the coil 2. The housing 3 is preferably designed to enclose the core support 4 with the core 1 and the coil 2. The housing 3 preferably has an opening, which is designed for inserting the core 1 with the coil 2 or the core support 4 with the core 1 and the coil 2 into the housing 3. The opening is preferably closed by the core support 4 in the inserted state. However, it is also possible that the opening is closed by a separate cover.

A potting compound 5 is arranged between the housing 3 and the core 1 with the coil 2 or the core support 4 with the core 1 and the coil 2. The core 1 with the coil 2 or the core support 4 with the core 1 and the coil 2 is inserted into the housing 3 and potted therein with the potting compound 5. The potting compound 5 is also often referred to as potting. The potting compound 5 preferably fills the, preferably all of the, cavities in the housing 3, so that the heat is effectively dissipated from the core 1 and the coil 2, and the core 1 with the coil 2 or the core support 4 with the core 1 and the coil 2 is stably mounted. A potting compound 5 which (in the cured state) is softer than 60 Shore A, preferably than 40 Shore A, preferably than 35 Shore A, preferably than 30 Shore A, preferably than 27 Shore A, preferably than 25 Shore A is preferably used. It has been found that the potting compound 5 softer than 60 Shore A or than the other preferred values mentioned, not only improves the rupture stability, but surprisingly also improves the stability of the electrical values of the antenna. Preferably, however, the potting compound 5 (in the cured state) is harder than 10 Shore A, preferably than 15 Shore A. The potting compound 5 with a deformation between 10 and 35 Shore A has been found to be particularly advantageous.

The antenna described is preferably designed for use in a vehicle, for the transmission of key data for opening and/or starting the vehicle. This antenna is preferably fitted in a vehicle.

For the production of the antenna, first the partial cores 1.1 and 1.2, arranged as described above, are fitted into the core support 4. The coil 2 is wound onto the core support 4. The coil wire is connected to the terminal of the antenna. The core 1 with the coil 2 or the core support 4 with the core 1 and the coil 2 is inserted into the housing 3. The core 1 with the coil 2 or the core support 4 with the core 1 and the coil 2 is potted in the housing 3 with the potting compound 5. After that, the potting compound 5 cures and the antenna is finished.

The invention claimed is:

1. Antenna comprising a magnetic core, a core support, and a coil, the magnetic core having at least two first partial cores, the at least two first partial cores being arranged directly adjacent to the other in a longitudinal direction of the magnetic core, each of the at least two first partial cores having a lateral side, the at least two first partial cores having a first first partial core and a second first partial core;

wherein the magnetic core has at least one second partial core, the at least one second partial core having a first second partial core, which is arranged on the lateral side of the first first partial core and on the lateral side of the second first partial core such that the first second partial core overlaps at least partially with the first first partial core and at least partially with the second first partial core, so that the first second partial core forms a magnetic bridge from the first first partial core to the second first partial core;

wherein the at least two first partial cores and the at least one second partial core are held in the core support, and the coil is wound around the core support; and the core support and coil being formed around the core support such that the winding of the coil presses the core support, which in turn presses the at least one second partial core against the lateral sides of the at least two first partial cores, for fixing the position of the at least one second partial core and the at least two first partial cores.

2. Antenna according to claim 1, the lateral side of the first first partial core forming a planar surface, the lateral side of the second first partial core forming a planar surface, the first second partial core having a lateral side, which forms a planar surface, the lateral side of the first second partial core lying on the lateral side of the first first partial core and on the lateral side of the second first partial core.

3. Antenna according to claim 1, the lateral side of the first first partial core being arranged parallel to the longitudinal direction of the core, and/or the lateral side of the second first partial core being arranged parallel to the longitudinal direction of the core, and/or the lateral side of the first second partial core being arranged parallel to the longitudinal direction of the core.

4. Antenna according to claim 1, a longitudinal axis of the first first partial core and/or a longitudinal axis of the second first partial core being arranged parallel to a longitudinal axis of the first second partial core.

5. Antenna according to claim 1, the first first partial core and the second first partial core being arranged one behind the other such that a longitudinal axis of the first first partial core represents an extension of a longitudinal axis of the second first partial core.

6. Antenna according to claim 1, the at least two first partial cores being arranged in a first plane and the at least one second partial core being arranged in a second plane, the second plane being parallel to the first plane.

7. Antenna according to claim 1, the first first partial core having a rectangular cross section and/or the second first partial core having a rectangular cross section, the first second partial core having a rectangular cross section, the magnetic core forming a rectangular cross section again in the region in which the first first partial core overlaps with the first second partial core and/or the magnetic core forming a rectangular cross section again in the region in which the second first partial core overlaps with the first second partial core.

8. Antenna according to claim 1, the at least two first partial cores having a third first partial core and the at least one second partial core having a second second partial core, the second second partial core being arranged on the lateral side of the second first partial core and on the lateral side of the third first partial core such that the second second partial core overlaps at least partially with the second first partial core and at least partially with the third first partial core.

9. Antenna according to claim 1, the core support extending over at least 80% of the length of the magnetic core, and/or the coil being wound onto the core support such that the coil extends over more than 80% of the length of the magnetic core.

10. Antenna according to claim 1, having a housing and a potting compound, the magnetic core with the coil being arranged in the housing and being potted with a potting compound in the housing, the potting compound being softer than 60 Shore A.

11. Vehicle having an antenna according to claim 1, the antenna being designed for the transmission of key data for opening and/or starting the vehicle.

12. An antenna according to claim 1 wherein the core support is arranged such that the first first partial core lies on a longitudinal axis of the second first partial core, and the second first partial core lies on a longitudinal axis of the first first partial core.

13. Production process for an antenna, comprising the steps of:

arranging a magnetic core in a core support;

winding a coil around the core support in which the magnetic core is arranged;

the magnetic core having at least two first partial cores, the step of arranging the magnetic core comprising arranging the at least two partial cores directly adjacent to the other in a longitudinal direction of the magnetic core; the at least two first cores having a first first partial core and a second first partial core;

wherein the magnetic core has at least one second partial core, the at least one second partial core having a first second partial core, the arranging of the magnetic core comprising the step of arranging the first second partial core, in which the first second partial core is arranged on the lateral side of the first first partial core and on the lateral side of the second first partial core such that the first second partial core overlaps at least partially with the first first partial core and at least partially with the second first partial core, so that the first second partial core forms a magnetic bridge from the first first partial core to the second first partial core wherein the core support and coil being formed around the core support such that the winding of the coil presses the core support, which in turn presses the at least one second partial core against the lateral sides of the at least two first partial cores, for fixing the position of the at least one second partial core and the at least two first partial cores.

14. Production process for an antenna according to claim 13 wherein the first first partial core and second first partial core are arranged along a longitudinal axis of the magnetic core in the core support, before winding the coil around the core support.

15. Production process for an antenna according to claim 13 further comprising the step of positioning the core support in which the magnetic core is arranged and around which the coil has been wound, into a housing, and potting with a potting compound.

* * * * *